US008801919B2

(12) United States Patent
Viljoen et al.

(10) Patent No.: US 8,801,919 B2
(45) Date of Patent: Aug. 12, 2014

(54) FULLY SYNTHETIC JET FUEL

(75) Inventors: Carl Louis Viljoen, Vanderbijlpark (ZA); Miriam Ajam, Sasolburg (ZA)

(73) Assignee: Sasol Technology (Pty) Ltd, Johannesburg (ZA)

( * ) Notice: Subject to any disclaimer, the term of this patent is extended or adjusted under 35 U.S.C. 154(b) by 181 days.

(21) Appl. No.: 13/386,857

(22) PCT Filed: Aug. 2, 2010

(86) PCT No.: PCT/ZA2010/000040

§ 371 (c)(1),
(2), (4) Date: May 7, 2012

(87) PCT Pub. No.: WO2011/017720

PCT Pub. Date: Feb. 10, 2011

(65) Prior Publication Data

US 2012/0209037 A1 Aug. 16, 2012

(30) Foreign Application Priority Data

Aug. 3, 2009 (ZA) ..... 2009/5411

(51) Int. Cl.
*C10L 1/04* (2006.01)
*C10L 1/16* (2006.01)

(52) U.S. Cl.
USPC ..... 208/15; 208/39; 208/950; 585/14; 44/300

(58) Field of Classification Search
USPC ..... 208/15, 39–45; 585/14
See application file for complete search history.

(56) References Cited

U.S. PATENT DOCUMENTS 4,645,585 A 2/1987 White
5,766,274 A * 6/1998 Wittenbrink et al. ..... 44/436
5,840,175 A * 11/1998 Aldous et al. ..... 208/87

(Continued)

FOREIGN PATENT DOCUMENTS

EP 2 034 004 A1 12/2007
WO WO 2004/090078 A1 4/2004
WO WO 2005/001002 A2 1/2005
WO WO 2009/062208 A2 11/2008

OTHER PUBLICATIONS

Moses et al. "Properties, Characteristics, and Combustion Performance of Sasol Fully Synthetic Jet Fuel", Journal of Engineering for Gas Turbines and Power, Jul. 2009, vol. 131, 041502, pp. 1-17.

*Primary Examiner* — Ellen McAvoy
(74) *Attorney, Agent, or Firm* — Knobbe, Martens, Olson & Bear, LLP.

(57) ABSTRACT

The invention provides a fully synthetic aviation fuel or aviation fuel component having: a total naphthenic content of more than 30 mass %, a mass ratio of naphthenic to iso-paraffinic hydrocarbon species of more than 1 and less than 15, a density (at 15° C.) of greater than 0.775 g·cm-3, but less than 0.850 g·cm-3, an aromatic hydrocarbon content of greater than 8 mass %, but less than 20 mass %, a freezing point of less than −47° C., a lubricity BOCLE WSD value of less than 0.85 mm. The invention further provides for the preparation of a fully synthetic coal-derived aviation fuel or aviation fuel component by blending a LFTF and a tar derived blend component. The invention extends to a method of producing a coal-derived, fully synthetic aviation fuel or aviation fuel component from coal gasifier tar and an LTLF derived fraction.

19 Claims, 1 Drawing Sheet

(56) References Cited

U.S. PATENT DOCUMENTS

Figure 1:
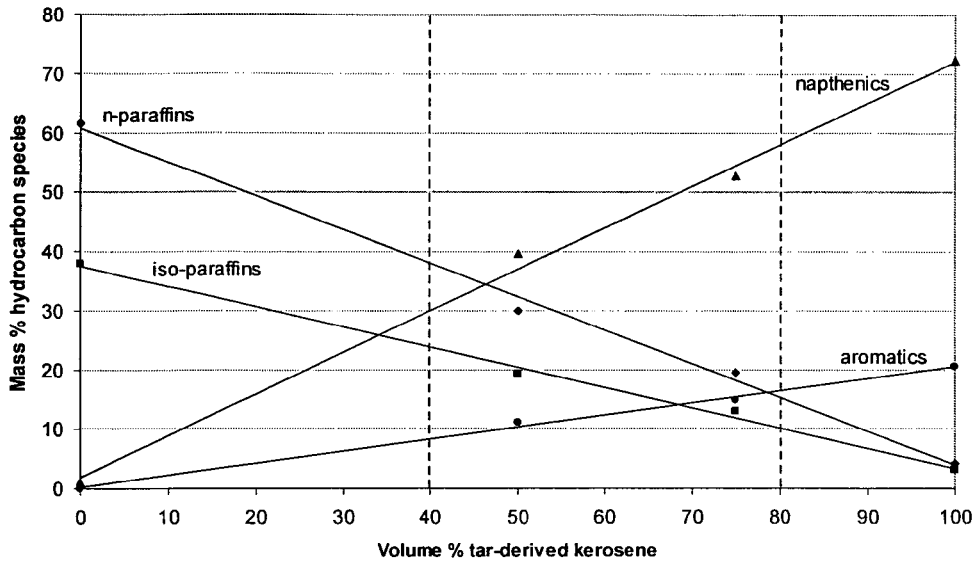

| | | | | |
|---|---|---|---|---|
| 6,309,432 | B1 * | 10/2001 | Wittenbrink et al. | 44/436 |
| 6,669,743 | B2 * | 12/2003 | Wittenbrink et al. | 44/436 |
| 6,890,423 | B2 | 5/2005 | O'Rear | |
| 7,390,397 | B2 * | 6/2008 | Lamprecht et al. | 208/308 |
| 7,608,181 | B2 * | 10/2009 | O'Rear | 208/15 |
| 7,785,378 | B2 * | 8/2010 | O'Rear | 44/452 |
| 8,183,419 | B2 * | 5/2012 | Lamprecht et al. | 585/14 |
| 8,193,401 | B2 * | 6/2012 | McGehee et al. | 585/24 |
| 8,231,775 | B2 * | 7/2012 | McGehee et al. | 208/22 |
| 8,444,718 | B2 * | 5/2013 | Clark et al. | 44/300 |
| 2009/0000185 | A1 | 1/2009 | Aulich et al. | |
| 2011/0061290 | A1 * | 3/2011 | Aulich et al. | 44/308 |

* cited by examiner

FULLY SYNTHETIC JET FUEL

CROSS-REFERENCE TO RELATED APPLICATIONS

This application is the national phase under 35 U.S.C. §371 of prior PCT International Application No. PCT/ZA2010/000040 which has an International filing date of Aug. 2, 2010, which designates the United States of America, and which claims the benefit of South Africa Patent Application No. 2009/5411 filed Aug. 3, 2009, the disclosures of which are hereby expressly incorporated by reference in their entirety and are hereby expressly made a portion of this application.

FIELD OF THE INVENTION

The present invention relates generally to aviation fuel and a blending stock for aviation fuel. More particularly, it relates to an aviation fuel or fuel component which is derived from a non-petroleum feedstock.

BACKGROUND OF THE INVENTION

Distillate fuels produced from non-petroleum sources and derived largely from the Fischer Tropsch (FT) process are typically highly paraffinic and have excellent burning properties and very low sulphur content. This makes them highly suitable as a fuel source where environmental concerns are important; and in circumstances where the security of supply and availability of petroleum supplies may cause concern.

However, although many physical properties for conventional distillate fuels can be matched and even outperformed, the fuels derived from FT processes and the like can not provide conventional jet fuel "drop-in compatibility" (i.e. be amenable to direct substitution within the conventional petroleum-derived jet fuel infrastructure), as they lack some of the major hydrocarbon constituents of typical petroleum-derived kerosene fuel. For example, due to their low aromatic content, FT jet fuels tend not to comply with certain industry jet fuel specified characteristics such as minimum density, seal swell propensity and lubricity.

This difficulty in obtaining suitable jet fuel entirely from non-petroleum feedstocks has triggered several developments in the downstream processing of feedstock in order to obtain suitable products.

For example, U.S. Pat. No. 4,645,585 teaches the production of novel fuels, including jet fuel components, from the extensive hydroprocessing of highly aromatic heavy oils such as those derived from coal pyrolysis and coal hydrogenation.

WO 2005/001002 relates to a distillate fuel comprising a stable, low-sulphur, highly paraffinic, moderately unsaturated distillate fuel blendstock. The highly paraffinic, moderately unsaturated distillate fuel blendstock is prepared from an FT-derived product that is hydroprocessed under conditions during which a moderate amount of unsaturates are formed or retained to improve stability of the product.

U.S. Pat. No. 6,890,423 teaches the production of a fully synthetic jet fuel produced from an FT feedstock. The seal swell and lubricity characteristics of the base FT distillate fuel are adjusted through the addition of alkylaromatics and alkylcycloparaffins that are produced via the catalytic reforming of FT product. This process can result in a suitable aviation fuel generated entirely from a non-petroleum source, but the additional reforming steps required to generate the alkylaromatics and alkylcycloparaffins impart significant additional cost and complexity to the process.

US2009/0000185 teaches a method for producing a jet fuel from two independent blendstocks, where at least one blendstock is derived from a non-petroleum derived feedstock, which may be an FT source. In one form of the described method, the second blendstock is also produced via a non-petroleum source, such as via the pyrolysis or liquefaction of coal. However, the provision of at least two independent synthetic feedstocks is highly problematic and less likely to be cost effective when contrasted with petroleum-based fuel sources.

Accordingly, there remains a strong need for a fully-synthetic (i.e. non-petroleum sourced) aviation fuel and an economical means of producing it.

SUMMARY OF INVENTION

A fully synthetic aviation fuel or aviation fuel component having:

- a total naphthenic content of more than 30 mass %
- a mass ratio of naphthenic to iso-paraffinic hydrocarbon species of more than 1 and less than 15
- a density (at 15° C.) of greater than 0.775 $g \cdot cm^{-3}$, but less than 0.850 $g \cdot cm^{-3}$
- an aromatic hydrocarbon content of greater than 8 mass %, but less than 20 mass %
- a freezing point of less than −47° C.
- a lubricity BOCLE WSD value of less than 0.85 mm The fully synthetic aviation fuel or aviation fuel component may have a mass ratio of naphthenic to aromatic hydrocarbons of from 2.5 to 4.5. Preferably, the mass ratio is between 3 and 4.

Preferably, the total naphthenic content of the synthetic aviation fuel or aviation fuel component is more than 35 mass %.

Preferably, the total naphthenic content of the synthetic aviation fuel or aviation fuel component is less than 60 mass %, and more preferably it is less than 50 mass %.

Preferably, the mass ratio of naphthenic to iso-paraffinic species of the synthetic aviation fuel or aviation fuel component is less than 10 and more preferably less than 5.

The aromatics content may be less than 18 mass % and more preferably less than 16 mass %.

Preferably the freezing point of the synthetic aviation fuels is less than −50° C., more preferably the freezing point is less than −53° C. and most preferably, the freezing point is less than −55° C.

The fully synthetic aviation fuel or fuel component is typically produced from a single non-petroleum source and comprises at least two blend components, where at least one component is produced from an LTFT process. The single source may be coal.

The fully synthetic aviation fuel or fuel component may have a freezing point that is lower than the freezing points of the blend components.

According to a second aspect of the invention, there is provided a fully synthetic coal-derived aviation fuel or aviation fuel component having a total naphthenic content of more than 30 mass %; a mass ratio of naphthenic to iso-paraffinic hydrocarbon species of more than 1 and less than 15; a density of greater than 0.775 $g \cdot cm^{-3}$ but less than 0.850 $g \cdot cm^{-3}$; an aromatic content of greater than 8 mass % but less than 20 mass %; a freezing point of less than −47° C. and a lubricity BOCLE WSD value of less than 0.85 mm including

- a first LTFT-derived blend component comprising at least 95 mass % isoparaffins and normal paraffins and less, than 1 mass % aromatics; with a density (at 15° C.) of less than 0.775 $g \cdot cm^{-3}$; and a second tar-derived blend component comprising at least 60 mass % naphthenics, at least 10 mass % aromatics and at least 5 mass % isoparaffins and normal paraffins, with a density (at 15° C.) of more than 0.840 $g \cdot cm^{-3}$;

such that the first LTFT-derived blend component may comprise at least 20 volume % and preferably no more than 60 volume % of the blend.

The second tar-derived blend component is typically generated through the deliberate recovery of a tar fraction generated during gasification of a coal feedstock for syngas production. The tar-derived kerosene fraction may further comprise at least 70% by mass naphthenics.

In a preferred embodiment of the invention, the volume ratio of the first and second blend components is between 45:55 and 55:45.

According to a third aspect of the invention, there is provided a method of producing a coal-sourced, fully synthetic aviation fuel or aviation fuel component; including the steps of:

gasifying the coal under medium temperature conditions in a fixed bed gasifier such that a tar fraction can be recovered during the coal gasification step; and syngas for an LTFT reactor is produced;

recovering from the LIFT reactor an LTFT syncrude;

subjecting the tar fraction to hydroprocessing under hydroprocessing conditions to provide a tar-derived kerosene fraction having at least 60 mass % naphthenics;

subjecting the LIFT syncrude to hydroprocessing under hydroprocessing conditions to provide a LTFT-derived kerosene fraction having at least 95 mass % isoparaffins and normal paraffins and less than 1 mass % aromatics; with a density (at 15° C.) of less than 0.775 $g \cdot cm^{-3}$; and blending the resultant tar-derived kerosene fraction and LIFT-derived kerosene fraction to obtain a fully synthetic aviation fuel or aviation fuel component.

The tar-derived kerosene fraction and the LTFT-derived kerosene fraction are blended in such a way that the LTFT-derived kerosene fraction may comprise at least 20 volume % and preferably no more than 60 volume % of the blend mixture. In a preferred embodiment of the invention, the ratio of the LTFT-derived kerosene and the tar-derived kerosene lies between 45:55 and 55:45.

The tar-derived kerosene fraction may be produced by a medium temperature coal gasification process (i.e. between 700 and 900° C.), for example by a Fixed Bed Dry Bottom (FBDB) (trade name) or fluidised bed coal gasification process. By employing a medium temperature process, a tar-derived kerosene component that contains both naphthenics and aromatics may be produced during the coal gasification step.

The hydrocarbon types of the tar-derived kerosene fraction will typically comprise between 60 and 80 mass % naphthenics. The hydrocarbon profile will typically further comprise between 15 and 30 mass % aromatics. The hydrocarbon type profile will typically further comprise between 5 and 15 mass % isoparaffins and normal paraffins.

In the specification, the terms "aromatics" and "aromatic hydrocarbons" are to have an equivalent meaning.

DETAILED DESCRIPTION OF THE INVENTION

According to the present invention, it has been found that it is possible to achieve a fully synthetic aviation fuel or fuel component that meets specific current conventional jet fuel requirements, (specifically density and aromatic content), through the suitable processing of a single synthetic fuel source.

This fuel is characterised in that it contains high levels of naphthenics or cycloparaffinic species relative to LTFT-derived kerosene fractions, which typically contain less than 1 mass % naphthenes.

Naphthenes typically form some component of petroleum-based aviation fuels (less than 30 mass %) and can contribute positively to certain required properties such as lowering the freezing point or enhancing seal swell propensity. They can however, contribute negatively to certain properties such as increased smoke point and viscosity. In addition, naphthenic species tend to be denser than paraffins with the same carbon number. Hence, the density of typical synthetic naphthenic-dominated kerosenes such as those generated by coal liquefaction and pyrolysis processes, will inevitably significantly, exceed the density requirements of aviation fuel specifications. Core to this invention therefore, is the development of a synthetic aviation fuel that capitalises on the positive properties of naphthenic species, whilst still meeting all the physical property requirements for aviation fuel, specifically density and smoke point.

This fuel can be produced using two parallel feedstock streams—one is generated via a conventional LTFT synthesis process; and the other is generated through the deliberate recovery of a tar fraction generated during medium temperature gasification of the coal feedstock for syngas production.

LTFT-Derived Kerosene Component

In this specification, reference is made to the Low Temperature Fischer-Tropsch (LTFT) process. This LTFT process is a well known process in which carbon monoxide and hydrogen are reacted over an iron, cobalt, nickel or ruthenium containing catalyst to produce a mixture of straight and branched chain hydrocarbon products ranging from methane to waxes and smaller amounts of oxygenates. This hydrocarbon synthesis process is based on the Fischer-Tropsch reaction:

$$2H_2+CO \rightarrow \sim[CH_2]\sim+H_2O$$

where $\sim[CH_2]\sim$ is the basic building block of the hydrocarbon product molecules.

The LTFT process is therefore used industrially to convert synthesis gas, which may be derived from coal, natural gas, biomass or heavy oil streams, into hydrocarbons ranging from methane to species with molecular masses above 1400. While the term Gas-to-Liquid (GTL) process refers to schemes based on natural gas (i.e. predominantly methane) to obtain the synthesis gas, the quality of the synthetic products is essentially the same once the synthesis conditions and the product work-up are defined.

While the main products are typically linear paraffinic species, other species such as branched paraffins, olefins and oxygenated components may form part of the product slate. The exact product slate depends on the reactor configuration, operating conditions and the catalyst that is employed. For example this has been described in the article Catal. Rev.-Sci. Eng., 23 (1&2), 265-278 (1981) or Hydroc. Proc. 8, 121-124 (1982), which is included by reference.

Preferred reactors for the production of heavier hydrocarbons are slurry bed or tubular fixed bed reactors, while operating conditions are preferably in the range of 160-280° C., in some cases in the 210-260° C. range, and 18-50 bar, in some cases preferably between 20-30 bar.

The catalyst may comprise active metals such as iron, cobalt, nickel or ruthenium. While each catalyst will give its own unique product slate, in all cases the product slate contains some waxy, highly paraffinic material which needs to be further upgraded into usable products. The LTFT products can be hydroconverted into a range of final products, such as middle distillates, naphtha, solvents, lube oil bases, etc. Such hydroconversion usually consists of a range of processes such as hydrocracking, hydroisomerisation, hydrotreatment and distillation.

For this invention, a suitable kerosene fraction is isolated from the hydroprocessed FT product using known methods. This LTFT-based kerosene is characteristically paraffinic and will usually contain little or no aromatics.

An example of suitable hydroprocessing conditions for this process step include:

temperatures of between 330 and 380° C.

pressures of between 35 and 80 bar

Liquid Hourly Space Velocity (LHSV) values of 0.5 to 1.5 per hour

A suitable reactor for this process would be a trickle flow fixed bed reactor.

This LTFT-derived kerosene fraction is then blended with a tar-derived kerosene fraction so as to achieve suitable physicochemical properties for a final aviation fuel or aviation fuel component. These may include the properties indicated in Table 1.

Tar-Derived Kerosene Component

Where syngas is required from coal for an FT process, by means such as high temperature gasification, for example high temperature entrained flow gasification processes, the higher temperatures required to produce syngas usually result in little or no useful tar product as this is cracked or hydrogenated during the gasification process.

The specific tar-derived kerosene fraction used in this invention is generated during a medium temperature gasification process, for example a Fixed Bed Dry Bottom (FBDB) (trade name) coal gasification process. During this process, typical temperature ranges for the included sub-processes may be:

combustion; from 1300-1500° C.

gasification itself; from 700-900° C.

reactor outlet temperature; 450-650° C.

By employing a medium temperature gasification process, an aromatic- and naphthenic-containing tar component can be isolated during coal gasification. In high temperature gasification processes, this tar component will not be preserved.

A medium temperature coal gasification process is a gasification process wherein slagging of the coal ash can not be tolerated and a dry ash is produced. This process can be carried out in a fixed bed or fluidised bed gasifier.

A fixed bed dry bottom gasifier (or fluidised bed gasifier) is a non-catalytic, medium temperature, pressurised gasifier for the production of synthesis gas from a solid carbonaceous feedstock such as coal by partial oxidation of the feedstock in the presence of a gasification agent comprising at least oxygen and steam or air and steam, with the feedstock being in lump or granular form and being contacted with the gasification agent in a fixed bed (or fluidised bed) and with the fixed bed (or fluidised bed) being operated at a temperature below the melting point of minerals contained in the coal.

The tar component initially forms part of the raw synthesis gas. When the raw synthesis gas is quenched, most of the tar/oil components are condensed into the liquid phase along with the steam. As the raw synthesis gas is further cooled, further tar/oil components are condensed from the raw synthesis gas stream at each cooling stage. The resultant liquor (gas condensate) streams are cooled and the tar/oil fraction is then removed from the aqueous phase using a system of gravity separators.

Middle distillates can then be produced by hydrocracking this tar/oil component. Suitable hydrocracking conditions for this process include:

temperatures of between 330 and 380° C.

pressures of between 125 and 180 bar

Liquid Hourly. Space Velocity (LHSV) values of 0.25 to 1.0 per hour

A suitable reactor for this process would be a trickle flow fixed bed reactor.

These fractions have a hydrocarbon profile that is quite different to that observed from the mainstream LTFT product—displaying a significantly naphthenic character with some aromatics.

Typically the hydrocarbon types for this kerosene fraction comprise:

between 15 and 30 mass % aromatics between 60 and 80 mass % naphthenics between 5 and 15 mass % combined isoparaffins and normal paraffins.

The exact character of this tar fraction can be established using sophisticated analytical separation techniques such as two-dimensional gas chromatography (GC×GC).

Blend Characteristics

The tar-derived and LTFT-derived kerosene fractions are blended in order to obtain a suitable aviation fuel or fuel component.

This blend will characteristically have a high level of naphthenics, typically more than 30 volume %, but this is coupled with an isoparaffinic content that allows a mass ratio of naphthenics to isoparaffinic species which is less than 15.

The range of blends from 40 volume % tar-derived kerosene/60% LTFT-derived kerosene to 80% tar-derived kerosene/20% LTFT-derived kerosene was found to meet all DEF-STAN 91-91 requirements for Jet A-1 fuel.

A minimum content of 40 volume % of tar-derived kerosene was determined to be the amount required in order to meet an 8 volume % aromatics level. A maximum content of 80 volume % of tar-derived kerosene was required in order to meet the maximum density specification (0.840 kg/l at 15° C.).

A more preferred range for the blend is one where the ratio of the first (LTFT) and second (tar-derived) kerosene fractions is between 45:55 and 55:45

The final blend of the non-petroleum components has a distinct naphthenic-rich character imparted by the addition of the tar-derived kerosene produced using medium temperature, fixed bottom gasification. The final synthetic aviation fuel or fuel component will therefore typically have a characteristic naphthenic content of no less than 30 volume/0 and no more than 60 volume %.

A further advantage of this invention lies in the modification of the freezing point of the blends with respect to the blend components. Whilst the blend components themselves have freezing points which are lower than the maximum aviation kerosene freezing point specification, namely −47° C.; applicant surprisingly found that the blend mixtures had freezing point values significantly reduced from those of the components. It seems that some synergistic interaction between the blend components facilitates a freezing point reduction of the blends of up to about 20% from that of the original components themselves.

The applicants postulate that this advantage may stem from the use of chemical diluent effects in mitigating against the negative effects of certain hydrocarbon species in the blend components. It is known that both n-paraffins in LTFT kerosene and aromatics in tar-derived kerosene typically have a detrimental effect on freezing point because of their individual ease of crystallisation. It appears that blending these species with components that also have a significant proportion of iso-paraffins and naphthenics results in a surprising (i.e. non-linear or non-interpolated) decrease in freezing point. However, given that each component already contained advantageous species prior to blending, it is suggested that it is the interaction between the dominant species contained in each blend component that is core to observing this the effect. The ratio of the advantageous species, namely iso-paraffins to naphthenics, is therefore highlighted as a critical feature of this invention. In order to further define the effective chemical window for this surprising behaviour, the ratio of naphthenics to aromatic species may also be identified.

The invention will now be described with reference to the following non-limiting examples.

EXAMPLE

Various blends of tar-derived kerosene and LTFT-derived kerosene were prepared as previously described using methods known in the art. These were analysed alongside the blend components and the results compared to known data for coal-liquefaction derived aviation kerosene. The specification analysis was performed according to ASTM test methods and compared with JP-A jet fuel specifications. The hydrocarbon characteristics of each of the kerosene samples were determined using two-dimensional gas chromatography (GC× GC).

DESCRIPTION OF TABLES AND FIGURES

Table 1 summarises results of the blends and blend components; and

Table 2 gives detailed results for these samples.

Figure 2:
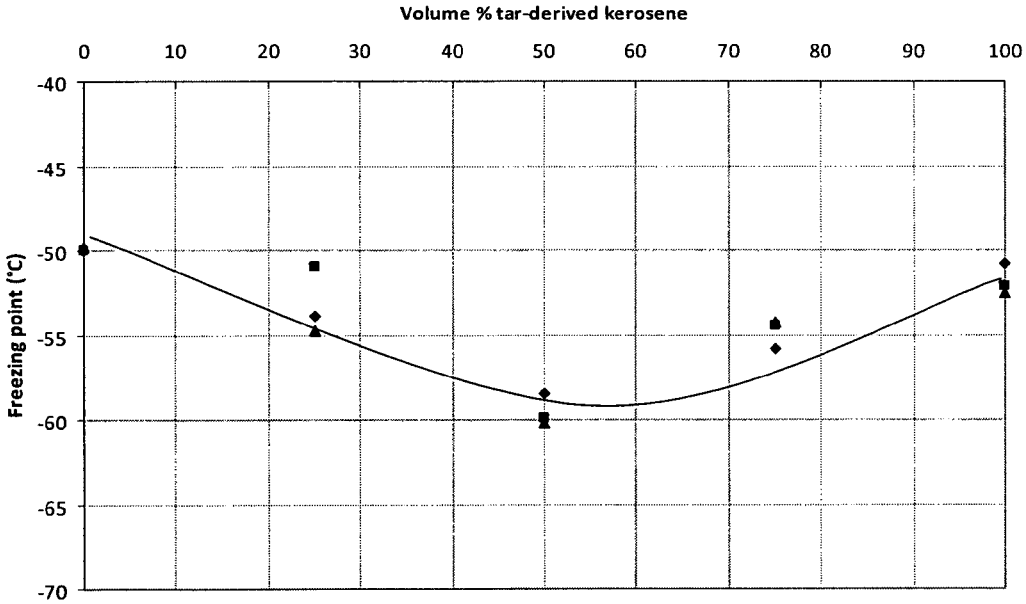

FIG. 1 shows the hydrocarbon species distribution for a representative set of blends; and FIG. 2 shows the freezing point values for this set of blends (with the inclusion of data for an out-of-specification blend for completion.)

TABLE 1

| | | | Kerosene type | | | | |
|---|---|---|---|---|---|---|---|
| Property | Units | JP-A spec. | LTFT | LTFT/tar blend A | LTFT/tar blend B | Tar-derived | Coal-derived* |
| LTFT kerosene | vol % | NA | 100 | 50 | 25 | — | NA |
| Tar-derived kerosene | vol % | NA | — | 50 | 75 | 100 | NA |
| Hydrocarbon type (analysis by GCxGC) | | | | | | | |
| n-paraffins | mass % | — | 61.61 | 29.9 | 19.45 | 4.09 | <1 |
| iso-paraffins | mass % | — | 37.38 | 19.3 | 13.01 | 3.13 | |
| Naphthenics | mass % | — | 1 | 39.7 | 52.72 | 72.19 | 97.3 |
| aromatics | mass % | — | 0.1 | 11.1 | 14.81 | 20.59 | 2.1 |
| Mass ratio of naphthenic: iso-paraffins | — | — | 0.1 | 2.1 | 4.1 | 23.1 | >90 |
| Mass ratio of naphthenics: aromatics | — | — | 10 | 3.58 | 3.56 | 3.51 | 46.3 |
| Property measurements (evaluated according to ASTM test methods | | | | | | | |
| Density@15° C. | $g \cdot cm^{-3}$ | 0.775-0.840 | 0.7364 | 0.8020 | 0.8342 | 0.8654 | 0.870 |
| Viscosity @−20° C. | cSt | 8.0 max | 1.84 | 3.68 | 4.51 | 7.46 | 7.5 |
| Smoke point | mm | 25.0 mm | 29 | 28 | 29 | 29 | 22 |
| Freezing point | ° C. | −47 | −49.8 | −58.4 | −55.8 | −50.9 | −53.9 |
| Lubricity: BOCLE, WSD | mm | 0.85 max | 0.60 | 0.51 | 0.66 | 0.54 | — |

*figures extracted from "Development of an advanced, thermally stable, coal-based jet fuel"; Schobert, H et al; Fuels Processing Technology, 89, (2008), 364-378

TABLE 2

Detailed properties of a tar-derived/LTFT kerosene blends

| | | | Results | | | | |
|---|---|---|---|---|---|---|---|
| Property | Units | Limits | LTFT kerosene | LTFT-tar-derived (75/25) | LTFT-tar-derived (50/50) | LTFT-tar-derived (25/75) | Tar-derived kerosene |
| Colour, Saybolt | — | Report | +30 | >+30 | >+30 | +30 | >+30 |
| Particulate Contaminants | mg/L | 1.0 max | 0.3 | <0.1 | <0.1 | <0.1 | <0.1 |
| COMPOSITION | | | | | | | |
| Total Acidity | mgKOH/g | 0.015 max | 0.058 | <0.001 | <0.001 | <0.001 | <0.001 |
| Olefins | vol % | | 0 | 0 | 0 | 0 | 0 |
| Paraffins[1] | vol % | | 100.0 | 95.3 | 91.4 | 85.9 | 83.9 |
| Total Aromatics | vol % | 26.5 max | 0 | 4.7 | 8.6 | 14.1 | 16.1 |
| Total Sulphur | mg/kg | | <1 | 10 | 12 | 11 | <1 |
| Total Nitrogen | mg/kg | | | <1 | <1 | 1 | <1 |
| Naphthalene | vol % | 3.0 max | | 0.18 | <0.01 | 1.16 | 0.17 |
| Bromine No | gBr/100 g | | | <0.1 | <0.1 | <0.1 | <0.1 |

TABLE 2-continued

| Detailed properties of a tar-derived/LTFT kerosene blends | | | | | | | |
|---|---|---|---|---|---|---|---|
| | | | Results | | | | |
| Property | Units | Limits | LTFT kerosene | LTFT-tar-derived (75/25) | LTFT-tar-derived (50/50) | LTFT-tar-derived (25/75) | Tar-derived kerosene |
| VOLATILITY | | | | | | | |
| Initial Boiling Point | ° C. | Report | 136.4 | 142.5 | 145.7 | 152.8 | 168.3 |
| 5% | ° C. | | 151.4 | 156.1 | 160.5 | 165.7 | 184.7 |
| 10% | ° C. | 205.0 max | 154.0 | 158.2 | 162.8 | 173.8 | 191.0 |
| 20% | ° C. | | 159.7 | 164.9 | 171.4 | 183.7 | 198.8 |
| 30% | ° C. | | 165.0 | 170.8 | 180.1 | 192.1 | 207.9 |
| 40% | ° C. | | 171.0 | 177.9 | 188.3 | 201.3 | 215.9 |
| 50% | ° C. | Report | 182.7 | 184.9 | 197.3 | 210.3 | 223.9 |
| 60% | ° C. | | 188.7 | 192.3 | 206.0 | 219.5 | 231.1 |
| 70% | ° C. | | 195.1 | 200.5 | 215.3 | 228.9 | 238.5 |
| 80% | ° C. | | 202.6 | 209.6 | 227.6 | 239.5 | 246.5 |
| 90% | ° C. | Report | 208.0 | 225.0 | 244.9 | 251.7 | 254.9 |
| 95% | ° C. | | 211.0 | 240.1 | 255.5 | 258.8 | 260.4 |
| Final Boiling Point | ° C. | 300.0 max | 215.8 | 256.2 | 261.0 | 264.0 | 264.6 |
| Recovery | vol % | | 98.6 | 98.4 | 98.3 | 98.3 | 98.4 |
| $T_{50}$-$T_{10}$ | ° C. | >20 | 28.7 | 26.7 | 34.5 | 36.5 | 32.9 |
| $T_{90}$-$T_{10}$ | ° C. | >40 | 54.0 | 66.8 | 82.1 | 77.9 | 63.9 |
| Flash Point | ° C. | 38.0 min | 40.5 | 44 | 46.5 | 53 | 52.0 |
| Density @ 15° C. | kg/L | 0.775-0.840 | 0.7364 | 0.7695 | 0.8020 | 0.8342 | 0.8654 |
| Density @ 20° C. | kg/L | 0.771-0.836 | 0.7334 | 0.7665 | 0.7990 | 0.8312 | 0.8624 |
| FLUIDITY | | | | | | | |
| Freezing Point | ° C. | −47.0 max | −49.8 | −53.9 | −58.4 | −55.8 | −50.8 |
| Viscosity @ −20° C. | $mm^2/s$ | 8.0 max | 1.84 | 2.62 | 3.68 | 4.51 | 7.46 |
| Viscosity @ 40° C. | cSt | | ? | 1.09 | 1.28 | 1.52 | 1.82 |
| COMBUSTION | | | | | | | |
| Specific Energy | MJ/kg | 42.80 min | 44.29 | 43.80 | 43.40 | 43.00 | 42.70 |
| Smoke Point | mm | 25.0 min | 29 | 27 | 28 | 29 | 29 |
| CORROSION | | | | | | | |
| Copper Corrosion | — | 1 max | 1B | 1A | 1B | 1A | 1B |
| THERMAL STABILITY (JFTOT) at 260° C. | | | | | | | |
| Filter Pressure Differential | mmHg | 25.0 max | 0 | 0 | 0 | 0 | 0 |
| Tube Deposit Rating | | <3 | <1 | <1 | <1 | <1 | <1 |
| CONTAMINANTS | | | | | | | |
| Existent gum | mg/100 mL | 7 max | 0.9 | 1.1 | 1.5 | 1.4 | 1.8 |
| Water content | mg/kg | | 17 | 25 | 45 | 24 | 30 |
| MSEP RATINGS | | | | | | | |
| Microsep - without Static Dissipator Additive | | 85 min | 92 | 88 | 89 | 88 | 96 |
| LUBRICITY | | | | | | | |
| BOCLE, WSD | mm | 0.85 max | 0.60 | 0.50 | 0.51 | 0.66 | 0.54 |

[1]This paraffin characterisation includes all saturated hydrocarbon species - namely linear paraffins (iso and normal), as well as cycloparaffins (also known as naphthenes)

The claims of the patent specification which follow form an integral part of the disclosure thereof.

The invention claimed is:

1. A fully synthetic aviation fuel or aviation fuel component having:

a total naphthenic content of more than 30 mass %;

a mass ratio of naphthenic hydrocarbon species to iso-paraffinic hydrocarbon species of (more than 1 and less than 15):1;

a density at 15° C. of greater than 0.775 $g \cdot cm^{-3}$ and less than 0.850 $g \cdot cm^{-3}$;

an aromatic hydrocarbon content of greater than 8 mass % and less than 20 mass %;

a freezing point of less than −47° C.; and a lubricity ball on cylinder lubricity evaluator wear scar diameter value of less than 0.85 mm.

2. The fully synthetic aviation fuel or aviation fuel component of claim 1, wherein the mass ratio of naphthenic hydrocarbon species to iso-paraffinic hydrocarbon species is (2.5 to 4.5):1.

3. The fully synthetic aviation fuel or aviation fuel component of claim 1, wherein the total naphthenic content is more than 30 mass % and less than 60 mass %.

4. The fully synthetic aviation fuel or aviation fuel component of claim 1, wherein the mass ratio of naphthenic hydrocarbon species to iso-paraffinic hydrocarbon species is (more than 1 and less than 5):1.

5. The fully synthetic aviation fuel or aviation fuel component of claim 1, wherein the aromatic hydrocarbon content is greater than 8 mass % and less than 18 mass %.

6. The fully synthetic aviation fuel or aviation fuel component of claim 1, wherein the aromatic hydrocarbon content is greater than 8 mass % and less than 16 mass %.

7. The fully synthetic aviation fuel or aviation fuel component of claim 1, wherein the freezing point is less than −55° C.

8. The fully synthetic aviation fuel or aviation fuel component of claim 1, derived from a single non-petroleum source and comprising a blend of at least two blend components, wherein at least one of the blend components is produced from a low temperature Fischer-Tropsch process.

9. The fully synthetic aviation fuel or aviation fuel component of claim 1, wherein the freezing point is lower than a freezing point of any of the blend components.

10. A method of preparing the fully synthetic aviation fuel or aviation fuel component of claim 1, comprising:

blending at least:

a first low temperature Fischer-Tropsch-derived blend component comprising at least 95 mass % isoparaffins and normal paraffins and less than 1 mass % aromatic hydrocarbons, and having a density at 15° C. of less than 0.775 $g \cdot cm^{-3}$; and a second tar-derived blend component comprising at least 60 mass % naphthenics, at least 10 mass % aromatic hydrocarbons and at least 5 mass % isoparaffins and normal paraffins, and having a density at 15° C. of more than 0.840 $g \cdot cm^{-3}$;

whereby a fully synthetic aviation fuel or aviation fuel component comprising from 20 volume % to 60 volume % of the first low temperature Fischer-Tropsch-derived blend component is obtained.

11. The method of claim 10, wherein the second tar-derived blend component is generated through a recovery of a tar-derived kerosene fraction generated during gasification of a coal feedstock for syngas production.

12. The method of claim 11, wherein the tar-derived kerosene fraction comprises at least 70 mass % naphthenics.

13. The method of claim 12, wherein a volume ratio of the first low temperature Fischer-Tropsch-derived blend component to the second tar-derived blend component is between 45:55 and 55:45.

14. A method of preparing the fully synthetic aviation fuel or aviation fuel component of claim 1, comprising:

gasifying a coal under medium to low temperature conditions in a fixed bed gasifier such that a tar fraction and syngas are recovered;

generating a low temperature Fischer-Tropsch syncrude from the syngas in a low temperature Fischer-Tropsch reactor;

subjecting the tar fraction to hydroprocessing under hydroprocessing conditions to obtain a tar-derived kerosene fraction comprising at least 60 mass % naphthenics;

subjecting the low temperature Fischer-Tropsch syncrude to hydroprocessing under hydroprocessing conditions to provide a low temperature Fischer-Tropsch-derived kerosene comprising at least 95 mass % isoparaffins and normal paraffins and less than 1 mass % aromatic hydrocarbons; and having a density at 15° C. of less than 0.775 $g \cdot cm^{-3}$; and blending the tar-derived kerosene fraction and the low temperature Fischer-Tropsch-derived kerosene to obtain a fully synthetic aviation fuel or aviation fuel component comprising from 20 volume % to 60 volume % of the low temperature Fischer-Tropsch-derived kerosene.

15. The method of claim 14, wherein a ratio of the low temperature Fischer-Tropsch-derived kerosene to the tar-derived kerosene fraction is between 45:55 and 55:45.

16. The method of claim 14, wherein the tar-derived kerosene fraction is produced by a medium temperature coal gasification process operating at a temperature of from 700 to 900° C., wherein both naphthenics and aromatic hydrocarbons are produced during the medium temperature coal gasification process.

17. The method of claim 14, wherein the tar-derived kerosene fraction comprises between 60 and 80 mass % naphthenics.

18. The method of claim 14, wherein the tar-derived kerosene fraction comprises from 15 to 30 mass % aromatic hydrocarbons.

19. The method of claim 14, wherein the tar-derived kerosene fraction comprises from 5 to 15 mass % isoparaffins and normal paraffins.

* * * * *